US006899073B2

(12) United States Patent
Tsutsumi et al.

(10) Patent No.: US 6,899,073 B2
(45) Date of Patent: May 31, 2005

(54) DECOMPRESSION DEVICE FOR INTERNAL COMBUSTION ENGINE

(75) Inventors: Koichi Tsutsumi, Wako (JP); Hidetoshi Takamatsu, Wako (JP); Itoko Kobayashi, Wako (JP); Ryuichi Abe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/853,957

(22) Filed: May 26, 2004

(65) Prior Publication Data

US 2004/0261744 A1 Dec. 30, 2004

(30) Foreign Application Priority Data

Jun. 4, 2003 (JP) ..... 2003-158861

(51) Int. Cl.[7] ..... F01L 13/08
(52) U.S. Cl. ..... 123/182.1
(58) Field of Search ..... 123/182.1

(56) References Cited

U.S. PATENT DOCUMENTS 4,672,930 A * 6/1987 Sumi ..... 123/182.1
5,816,208 A * 10/1998 Kimura ..... 123/182.1

FOREIGN PATENT DOCUMENTS

JP 2002-242631 8/2002

* cited by examiner

*Primary Examiner*—Andrew M. Dolinar
(74) *Attorney, Agent, or Firm*—Merchant & Gould P.C.

(57) ABSTRACT

A decompression device is provided for an internal combustion engine having a cylinder head provided with a pair of left and right camshaft bearings sandwiching intake valves and exhaust valves with a structure that is both simple and small. A camshaft is provided having cam projections for at least a pair of intake cams between camshaft side bearings corresponding to the pair of left and right bearings, and a decompression member with a decompression cam with a centrifugal weight arranged at a camshaft end passing through the bearing close to the camshaft end so that a tip thereof is arranged in the vicinity of the cam projections, with the decompression member comprising the centrifugal weight, the decompression cam, and a rotatable shaft coupling the centrifugal weight and the decompression cam in an integral manner.

3 Claims, 14 Drawing Sheets

FIG. 13
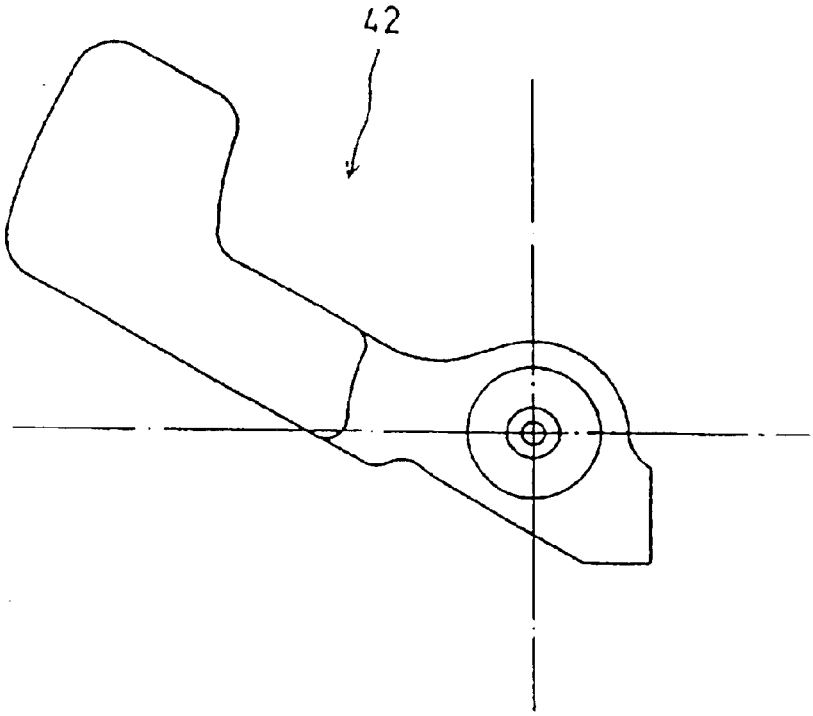
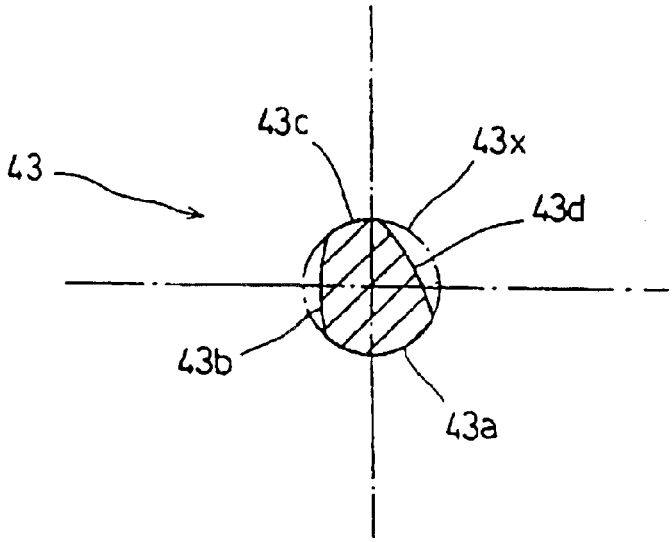
FIG. 14

DECOMPRESSION DEVICE FOR INTERNAL COMBUSTION ENGINE

FIELD OF THE INVENTION

The present invention relates to a decompression device for lower compression pressure to enable easy starting when starting a four-stroke cycle internal combustion engine.

BACKGROUND OF THE INVENTION

An example from related art, Japanese Patent Laid-open No. 2002-242631, a valve gear is equipped with a camshaft supported in a freely rotatable manner via a pair of main bearings at a camshaft holder fastened to a cylinder head using a bolt, a pair of valve lifters for opening and closing a pair of intake valves, a rocker shaft fixed and supported at the camshaft holder having an axis parallel with the axis of rotation of the camshaft, and a rocker arm supported in a freely swinging manner at the same rocker shaft.

A pair of intake cams having the same prescribed cam surface, and a single exhaust cam having a prescribed surface positioned at a substantially central position between the intake cams are then formed at the camshaft. The pair of intake cams make sliding contact with the top surfaces of the pair of valve lifters, the valve lifters slide according to the cam surface, and the pair of intake valves open and close at a prescribed opening and closing timing by a prescribed lift amount.

A roller making rolling contact with one exhaust cam is supported in a freely rotating manner at one side of the rocker arm camshaft, and a branch dividing into two is formed at the other side. The end of each branch makes contact with the upper end surfaces of the stems of the pair of exhaust valves, and both of the exhaust valves open and close at a prescribed timing and by a prescribed lift amount according to the exhaust cam surface.

With related decompression devices, a centrifugal weight and a decompression cam linking with this centrifugal weight are provided at the outer side of one of the bearings supporting the camshaft, a decompression cam arm making contact with one end of a slipper so as to perform sliding driving is provided at one end of the decompression cam, with one end of the rocker arm branching section being driven by the other end of the decompression arm, so that the exhaust valve is driven so as to be opened and closed for decompression.

With decompression devices of the related art, because the decompression cam is arranged on the outside of the bearings, a decompression cam extending to the tip of the branching part for driving the exhaust valves to open and close from the decompression cam is required, the structure becomes complex, and the cylinder head also becomes large. The present invention therefore sets out to provide a decompression device that is simple in structure and small in size.

SUMMARY OF THE INVENTION

In order to resolve the aforementioned problems, a decompression device is provided for an internal combustion engine equipped with intake valves and exhaust valves and having a cylinder head provided with a pair of left and right camshaft bearings sandwiching the intake valves and exhaust valves, comprising a camshaft having cam projections for at least a pair of intake cams between camshaft side bearings corresponding to the pair of left and right bearings, and a decompression member with a decompression cam with a centrifugal weight arranged at a camshaft end passing through the bearing close to the camshaft end so that a tip thereof is arranged in the vicinity of the cam projections, with the decompression member comprising the centrifugal weight, the decompression cam, and a rotatable shaft coupling the centrifugal weight and the decompression cam in an integral manner.

As described above, a centrifugal weight is arranged at a camshaft end and the end of a decompression cam linked to the centrifugal weight via a rotatable axis is passed through a bearing close to the end of the camshaft so as to be arranged close to the cam projections. The decompression arm of the related art is therefore no longer required, the structure is simplified, and the cylinder head can be made smaller.

In another aspect of the invention, a power transmission member for transmitting power from the crankshaft to the camshaft may be provided at the outer side of one of the bearings of the pair of left and right camshaft bearings, the intake valve cam projection of the intake/exhaust cam projections is provided close to the bearing on the opposite side to the side where the power transmission member is installed, and the pair of bearings supporting a rotating shaft of the decompression member is formed split to the left and right of the intake valve cam projection.

As described above, bearings supporting a rotatable shaft of the decompression member are spaced to the left and right from intake cam projections. The gap between the bearings can therefore be kept large, and the durability of the decompression device can be improved.

Further, a bearing member with common internal and external diameters may be provided between the cylinder head and the camshaft.

The present invention therefore enables the bearing members to be made common, the types of parts can be reduced, and ease of assembly can be enhanced.

BRIEF DESCRIPTION OF THE DRAWINGS

FIG. 13 is a view along XIII of FIG. 12

FIG. 14 is a cross sectional drawing along XIV—XIV in FIG. 12

DETAILED DESCRIPTION OF THE INVENTION

Figure 1:
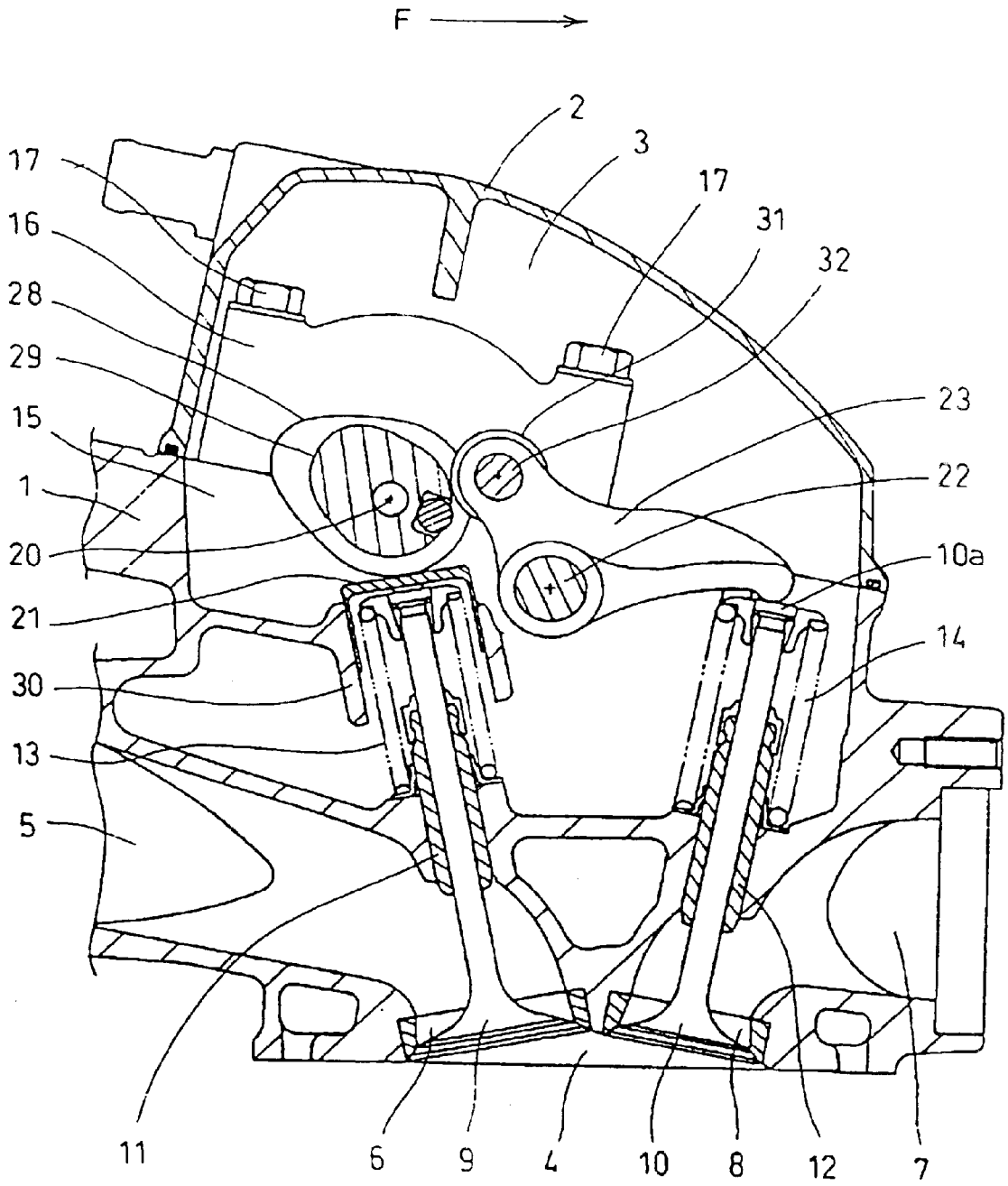
FIG. 1 is a vertical cross-sectional view of a valve chamber for an internal combustion engine to which each embodiment of the present invention relates.

FIG. 1 is a vertical cross-sectional view of a valve chamber for an internal combustion engine to which each embodiment of the present invention relates. The internal combustion engine to which the decompression device of the present invention is applied is an overhead camshaft-type single-cylinder reciprocating four-stroke cycle internal combustion engine mounted on a motorcycle. An arrow F designates the front direction when the internal combustion engine is mounted on the vehicle. A valve chamber 3 is formed between a cylinder head 1 coupled to an upper end surface of a cylinder block (not shown) into which pistons (not shown) are inserted so as to freely move in a reciprocal manner and a cylinder head cover 2 coupled to an upper end surface of the cylinder head 1. A combustion chamber 4 is formed between the lower surface of the cylinder head 1 and the pistons.

An intake port 5 for the cylinder head 1 is formed to the rear of the vehicle (left side in FIG. 1), and branches into two so as to form a pair of intake openings 6 opening at the combustion chamber 4. An exhaust port 7 for the cylinder head 1 is formed to the front of the vehicle (right side in FIG. 1), and branches into two so as to form a pair of exhaust openings 8 opening at the combustion chamber 4.

A pair of intake valves 9 for opening and closing the intake openings 6 and a pair of exhaust valves 10 for opening and closing the exhaust openings 8 are fitted in a freely slidable manner into valve sleeves 11, 12 press-fitted at the cylinder head 1. The intake valves 9 and exhaust valves 10 are urged so as to close the corresponding intake openings 6 and the exhaust openings 8 using spring force of valve springs 13, 14. An intake pipe (not shown) is connected to an upstream side of the intake port 5, and a carburetor (not shown) for forming a fuel/air mixture provided to the combustion chamber 4 is fitted to the end of the intake pipe. An exhaust pipe (not shown) for exhausting combusted gas from the combustion chamber 4 is connected to a downstream-side opening of the exhaust port 7.

Figure 2:
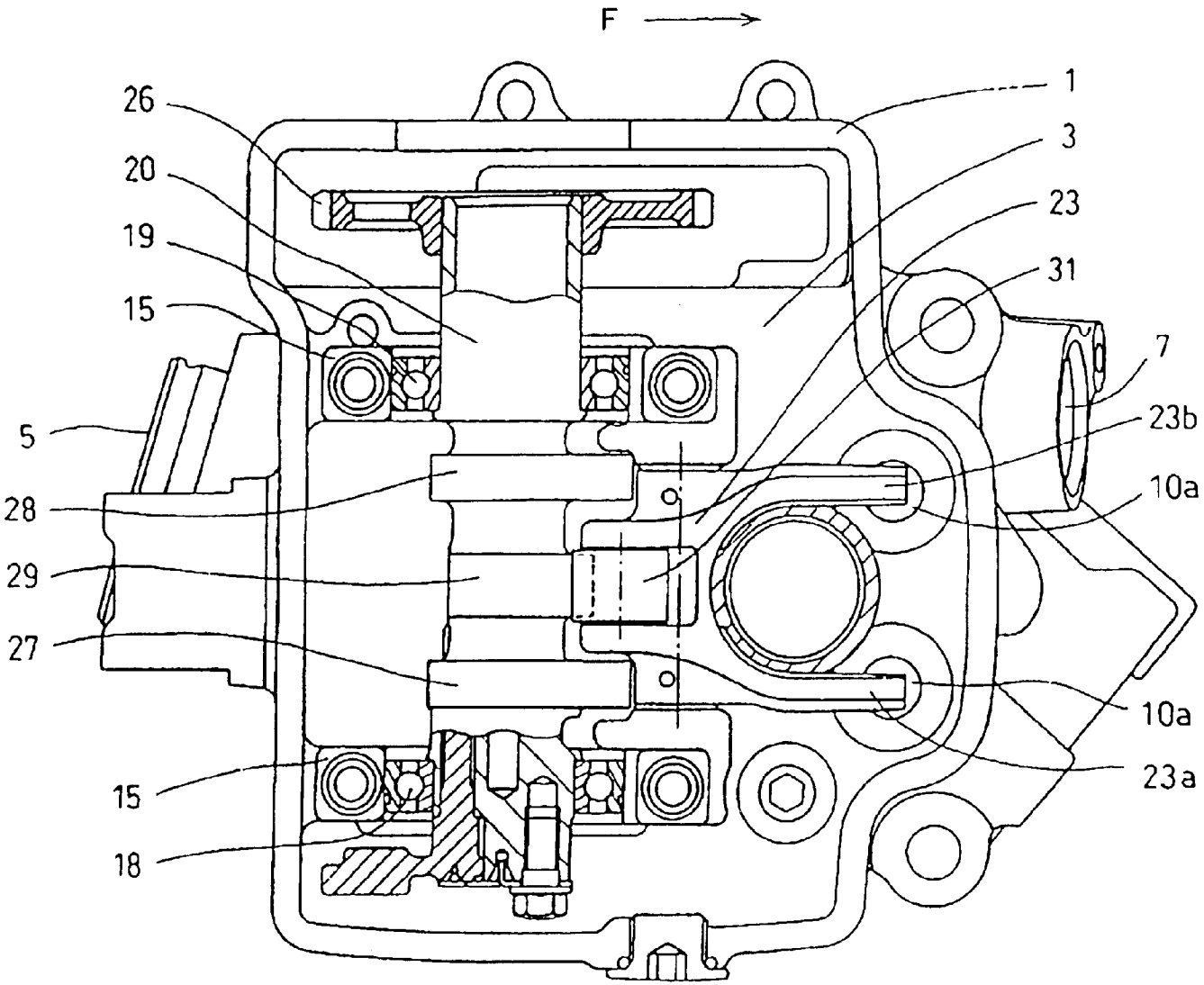
FIG. 2 shows the inside of the valve chamber as viewed from above with the cylinder head cover of the internal combustion engine removed.

FIG. 2 shows the inside of the valve chamber as viewed from above with the cylinder head cover of the internal combustion engine removed. A description is now given with reference to FIG. 1 and FIG. 2. The valve assembly housed in the valve chamber 3 comprises a lower camshaft holder 15 formed at the cylinder head 1 so as to be vertically split into two from a camshaft center line position, an upper camshaft holder 16 fastened to the lower camshaft holder 15 using a bolt 17, a camshaft 20 supported in a freely rotatable manner via a pair of main bearings 18, 19 of common internal diameter, a pair of valve lifters 21 for opening and closing the pair of intake valves 9, a rocker shaft 22, having an axis parallel with the axis of rotation of the camshaft 20, and being supported in a fixed manner by the upper and lower camshaft holders 15, 16, and a rocker arm 23 supported in a freely sliding manner at the same rocker shaft 22.

The camshaft 20 is rotatably driven by the pistons and has an axis of rotation parallel with the axis of rotation of the crankshaft. The camshaft 20 is rotatably driven at a rotational speed that is half that of the crankshaft as a result of power of the crankshaft via a timing chain spanning a driving sprocket coupled to the crankshaft and a driven sprocket 26 coupled to the left end of the camshaft 20.

A pair of intake cams 27, 28 having the same prescribed cam surface and a single exhaust cam 29 having a prescribed cam surface positioned substantially at the center of the intake cams 27, 28. The pair of intake cams 27, 28 make sliding contact with a top faces of the valve lifters 21 fitted in a freely slidable manner within a guide tube 30 (FIG. 1) formed at the cylinder head 1, with the valve lifters 21 sliding in accordance with the cam surface, with the pair of intake valves 9 opening and closing at a prescribed opening and closing timing and lift amount.

A roller 31 making rolling contact with an exhaust cam 29 is supported in a freely rotating manner by a roller shaft 32 at a side of the camshaft 20, with two-way branches 23*a* and 23*b* being formed at the other side. The ends of each branch 23*a*, 23*b* make contact with valve stem end surfaces 10*a* of the pair of exhaust valves 10. The exhaust cam 29 causes the rocker arm 23 to swing via the contacting roller 31 according to the cam surface, and both exhaust valves 10 are opened and closed at the prescribed timings and by the prescribed lift amounts.

Figure 3:
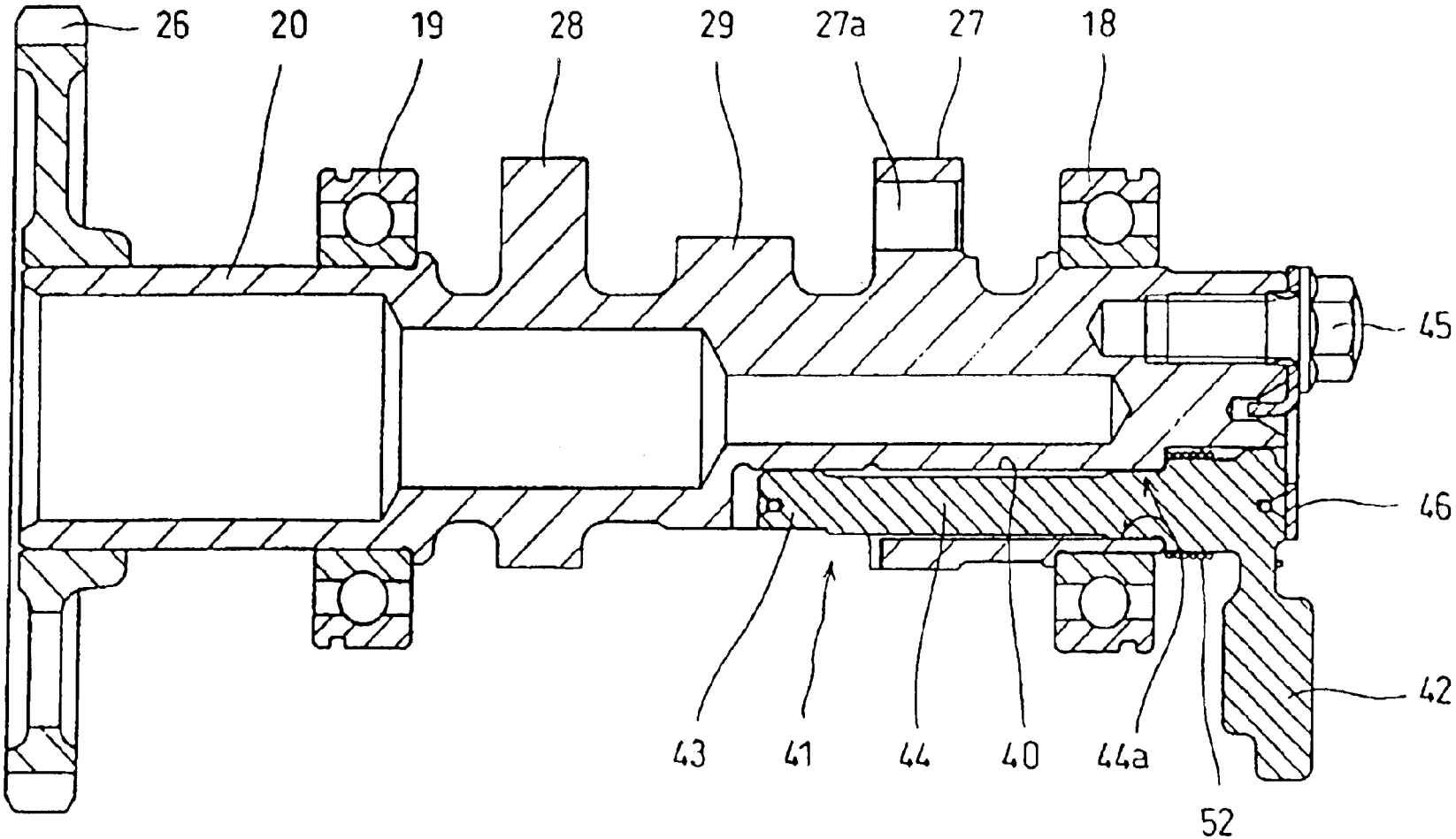
FIG. 3 is a longitudinal cross-sectional view of a camshaft and portions linked to this camshaft.

FIG. 3 is an enlarged vertical cross-sectional view of portions comprised of the camshaft 20 shown in FIG. 2, the driven sprocket 26 linked to the camshaft 20, and the main bearings 18, 19, etc. A decompression member insertion hole 40 is provided at the camshaft 20 parallel with the axis of rotation of the camshaft 20, and a decompression member 41 is inserted in a freely rotatable manner therein. The details of the shape of the decompression member 41 are described in detail later, but it comprises a centrifugal weight 42, a decompression cam 43, and a rotatable shaft 44 formed so as to integrally couple the centrifugal weight 42 and the decompression cam 43. The decompression member 41 is prevented from slipping by a slipping prevention plate 46 fastened by a bolt 45 to the end of the camshaft 20. Each cam projection of each of the intake cam 27, exhaust cam 29, and intake cam 28 are provided between the pair of main bearings 18, 19 in order from the right side. A through-hole 27*a* provided at the cam projection of the intake cam 27 is a hole used for deciding relative position in the direction of rotation at the time of coupling the camshaft 20 and the driven sprocket 26.

Figure 4:
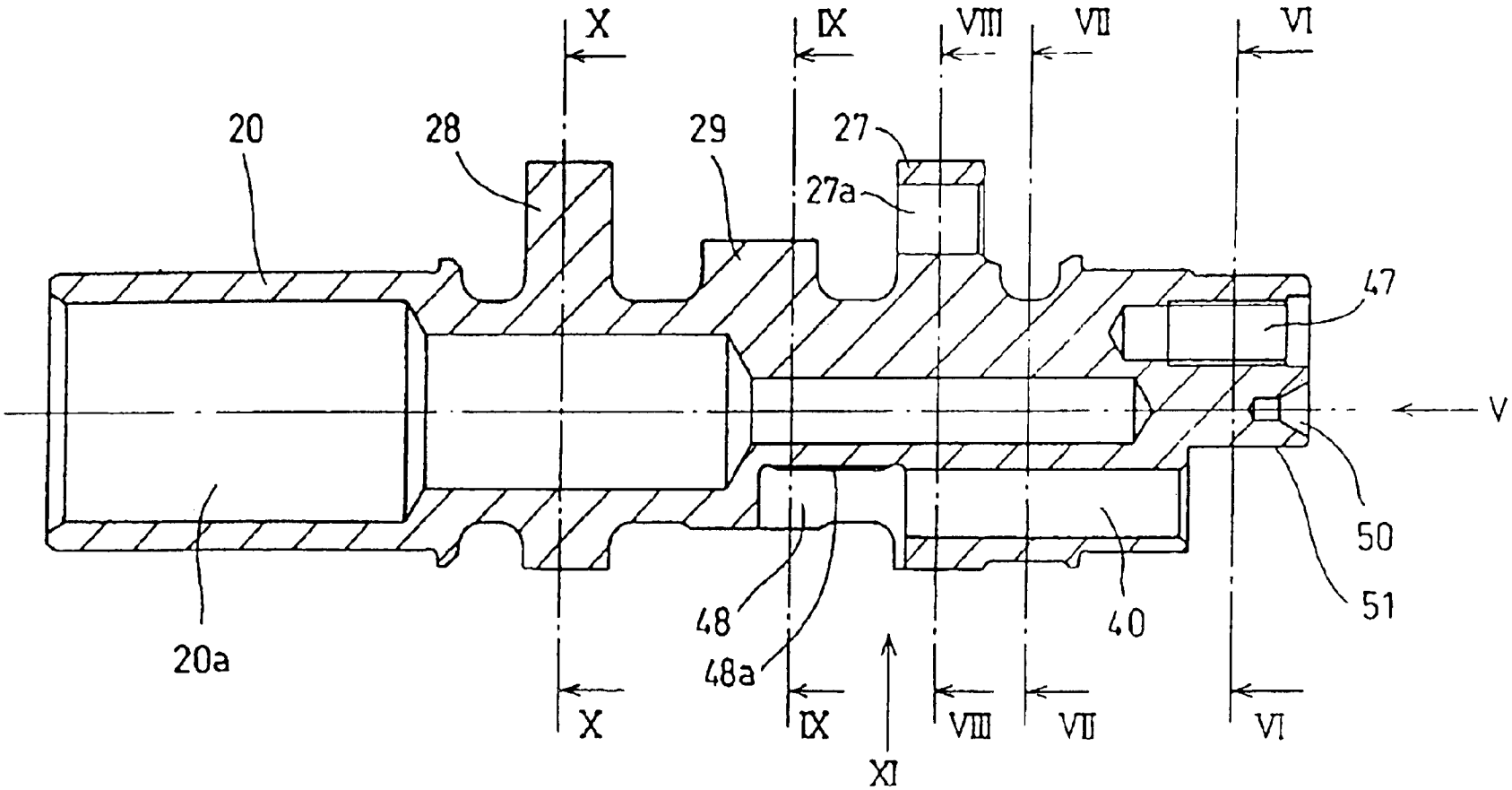
FIG. 4 is an enlarged cross-sectional view of the camshaft.

FIG. 4 is a vertical cross-sectional view of the camshaft 20 shown in FIG. 3. In the drawings, a decompression cam-containing hole 48 is formed at the back end of the decompression member insertion hole 40, and the decompression cam 43 is contained in the decompression cam containing hole 48. A bolt hole at the right end of the camshaft 20 is an insertion hole 47 for the plate fastening bolt 45 for fastening the slipping prevention plate 46. A funnel-shaped hole at the center of the left end surface of the camshaft 20 is an engaging hole 50 for a rotation prevention pawl forming part of the slipping prevention plate 46. The left end of the camshaft 20 constitutes a stopper 51 with which the centrifugal weight 42 of the decompression member 41 comes into contact at both ends of the range or rotation. A hollow section 20*a* is provided at the central part of the camshaft 20 to ensure lightness in weight.

Figure 5:
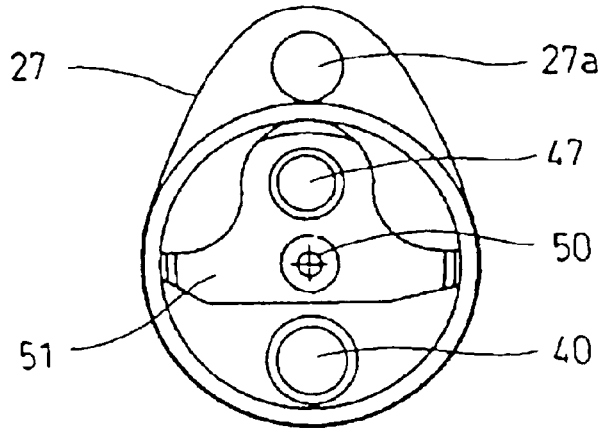
FIG. 5 is a view along V of FIG. 4.
Figure 6:
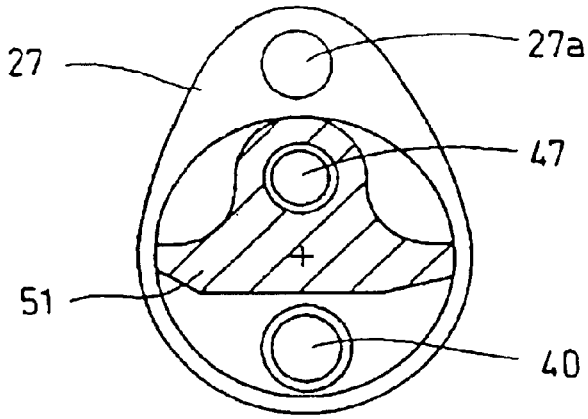
FIG. 6 is a cross sectional drawing along VI—VI in FIG. 4.
Figure 7:
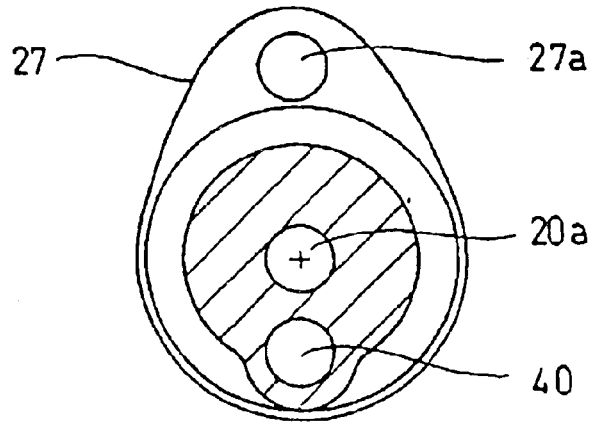
FIG. 7 is a cross sectional drawing along VII—VII in FIG. 4.
Figure 8:
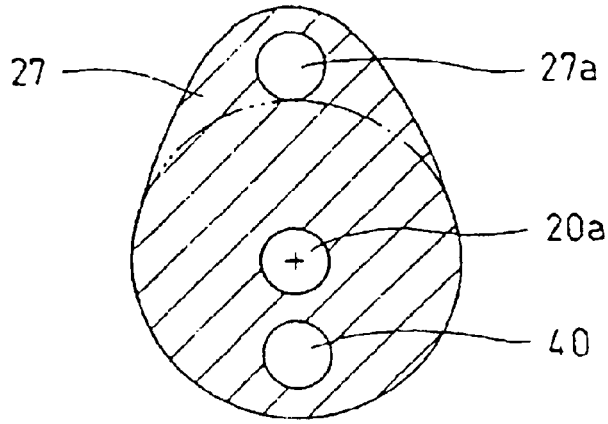
FIG. 8 is a cross sectional drawing along VIII—VIII in FIG. 4.
Figure 9:
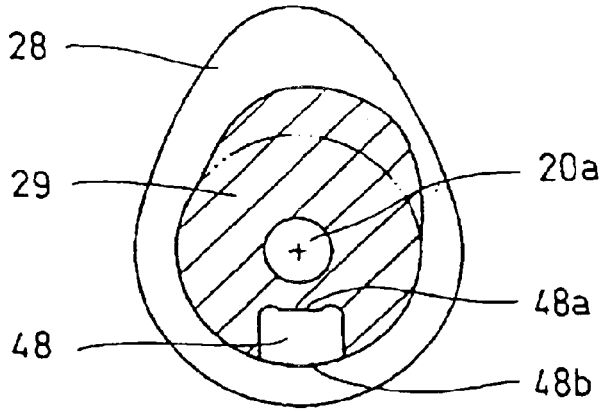
FIG. 9 is a cross sectional drawing along IX—IX in FIG. 4.
Figure 10:
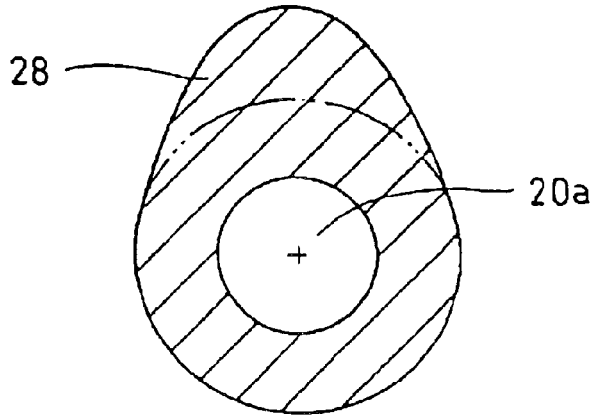
FIG. 10 is a cross sectional drawing along X—X in FIG. 4.
Figure 11:
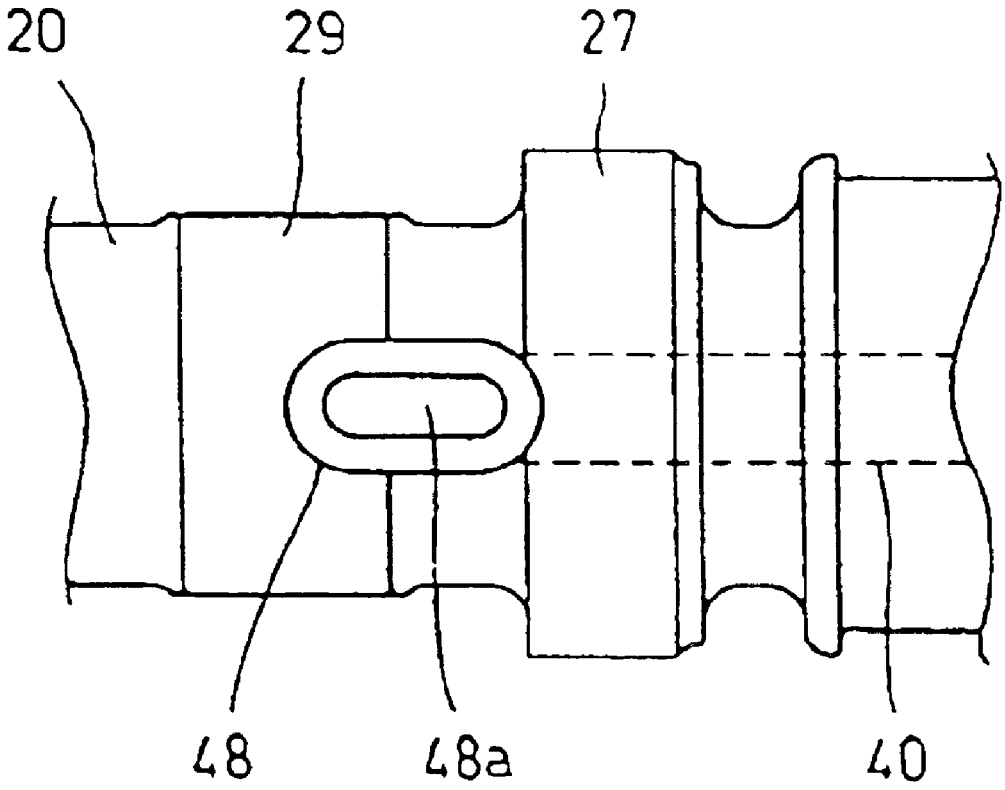
FIG. 11 is a view along XI of FIG. 4.

A view taken along V of FIG. 4 is shown in FIG. 5, a cross-sectional view taken along VI—VI of FIG. 4 is shown in FIG. 6, a cross-sectional view along VII—VII of FIG. 4 is shown in FIG. 7, a cross-sectional view taken along VIII—VIII of FIG. 4 is shown in FIG. 8, a cross-sectional view taken along IX—IX of FIG. 4 is shown in FIG. 9, a cross-sectional view taken along X—X in FIG. 4 is shown in FIG. 10, and a view along XI of FIG. 4 is shown in FIG. 11. As can be seen from FIG. 4, FIG. 9 and FIG. 11, a flat bottom surface 48*a* is formed at the bottom part of the decompression cam-containing hole 48 formed by making a hole in part of the exhaust cam 29. The decompression cam then frequently appears from an opening 48*b* (FIG. 9) of the decompression cam-containing hole 48. As can be seen from FIG. 4, FIG. 5 and FIG. 6, a stopper 51 for the centrifugal weight 42 of the decompression member 41 to make contact with both ends of the range of rotation is formed at the right end of the camshaft 20.

Figure 12:
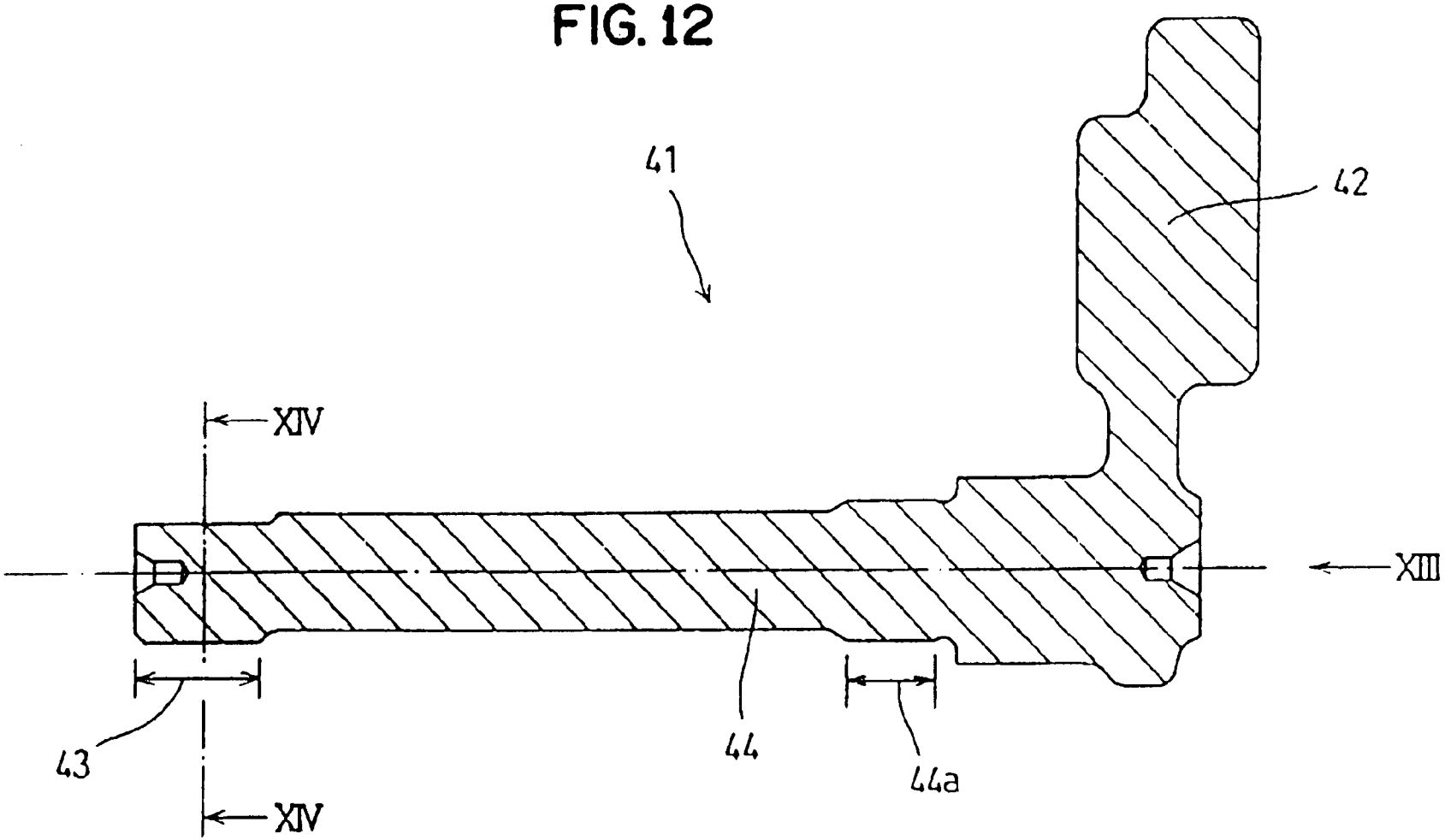
FIG. 12 is an enlarged cross-sectional view of the decompression member.

FIG. 12 is an enlarged vertical cross-sectional view of the decompression member 41 shown in FIG. 3. FIG. 13 is a view along XIII of the centrifugal weight 42 of FIG. 12 viewed from the right side. FIG. 14 is a cross-sectional view along XIV—XIV of the decompression cam of FIG. 12. The centrifugal weight 42 and the decompression cam 43 are coupled by the rotatable shaft 44 of circular cross-section formed integrally with these portions. The decompression cam 43 is equipped with a decompression acting surface 43*a* consisting of the same curved surface as that of a decompression cam outer cylinder surface 43*x*, a decompression releasing surface 43*b* cut so as to be formed from the same curved surface as an exhaust cam outer surface 29*a*, a decompression cam supporting surface 43*c* constituted by the same curved surface as for the decompression cam outer cylinder surface 43*x*, and an escape surface 43*d* formed by cutting away part of the outside of the decompression cam 43. The relationship between the relative position of the decompression cam 43 with respect to the exhaust cam 29 and the actions of each surface are described in the following.

Figure 15:
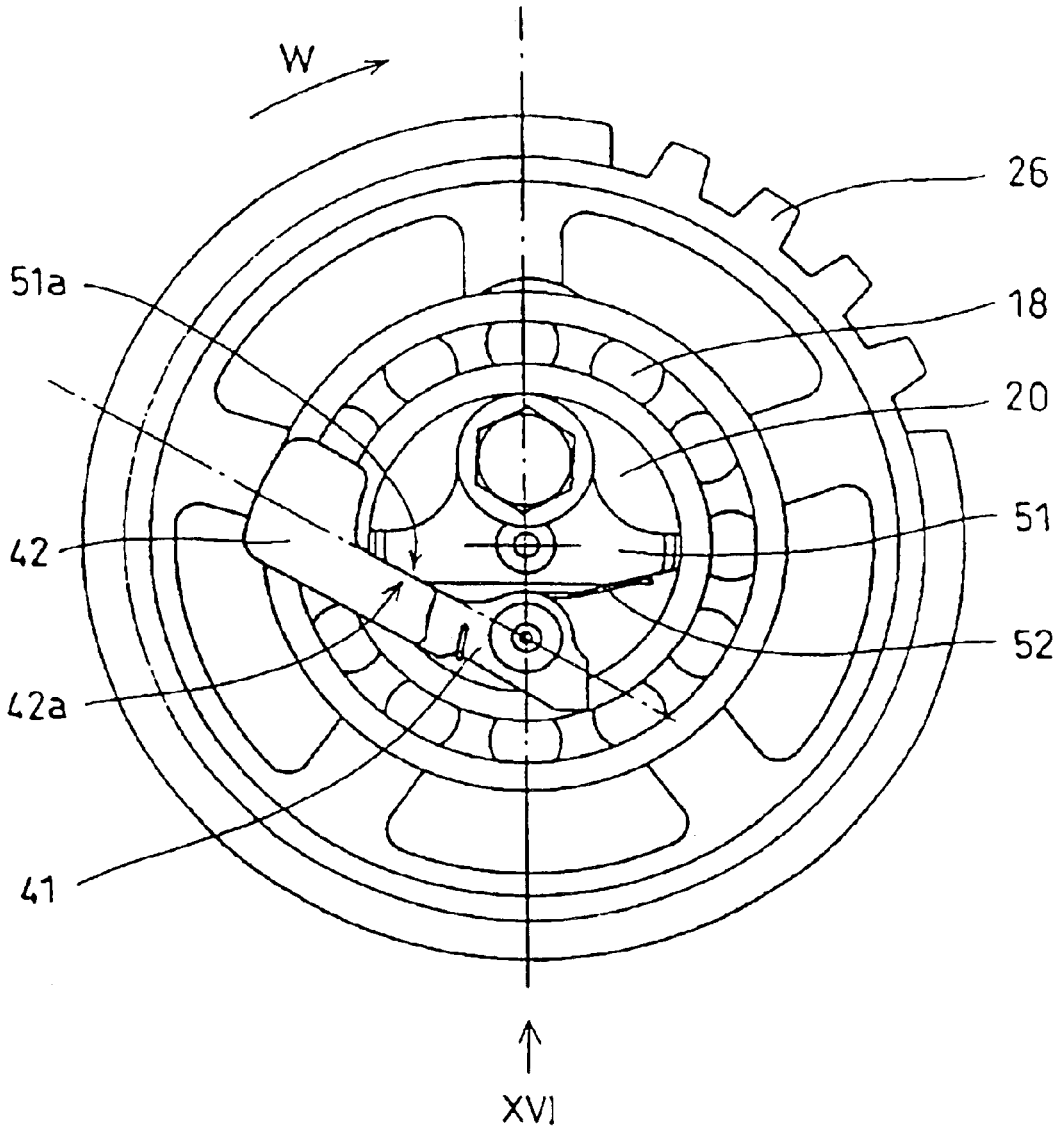
FIG. 15 is a view showing the camshaft and members linked to the camshaft from the right side of the camshaft, and shows the position of the decompression member of the camshaft during stopping and during low-speed rotation.

FIG. 15 is a view showing the camshaft 20 and the centrifugal weight 42 as viewed from the right of the camshaft 20. The decompression member slipping prevention plate 46 is omitted from the drawings in order to prevent the drawings becoming complex.

Figure 16:
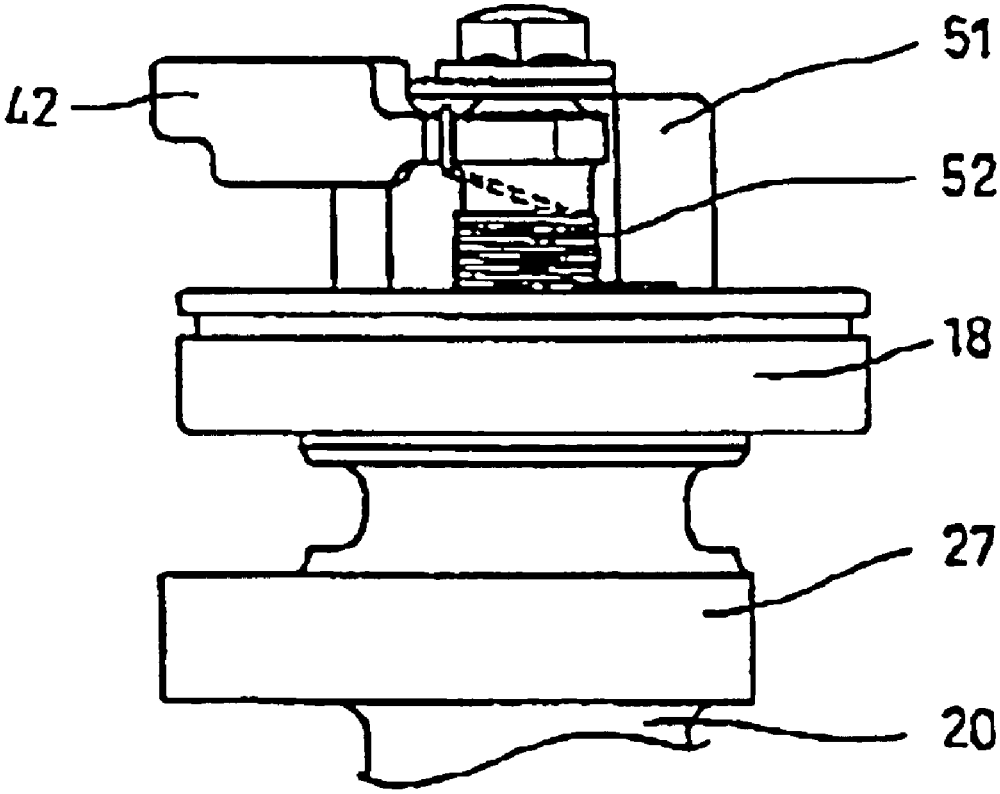
FIG. 16 is a view along arrow XVI of FIG. 15.

FIG. 16 is view taken along XVI of FIG. 15. A coil spring 52 is provided at the rotatable shaft 44 of the decompression member. The coil spring 52 urges the arm of the centrifugal weight 42 in the direction of the stopper surface 51 at the time of low speed rotation of the stopper 51 shown in FIG. 15 when the internal combustion engine is stopped.

FIG. 15 and FIG. 16 show the situation when the camshaft 20 is rotating at a low speed less than the decompression operation release rotational speed set by adjusting the coil spring force of the coil spring 52, or is stopped. When the driven sprocket 26 rotates in accompaniment with rotation of the crankshaft, the camshaft 20 rotates in the direction of arrow W. When the camshaft 20 is rotating at a low rotational speed less than the rotational speed set as described above, a side surface 42*a* of the arm comes into contact with the stopper surface 51*a* at the time of low-speed rotation of one side surface of the stopper 51 and comes to a halt due to the urging force of the coil spring 52, as shown in FIG. 15.

Figure 17:
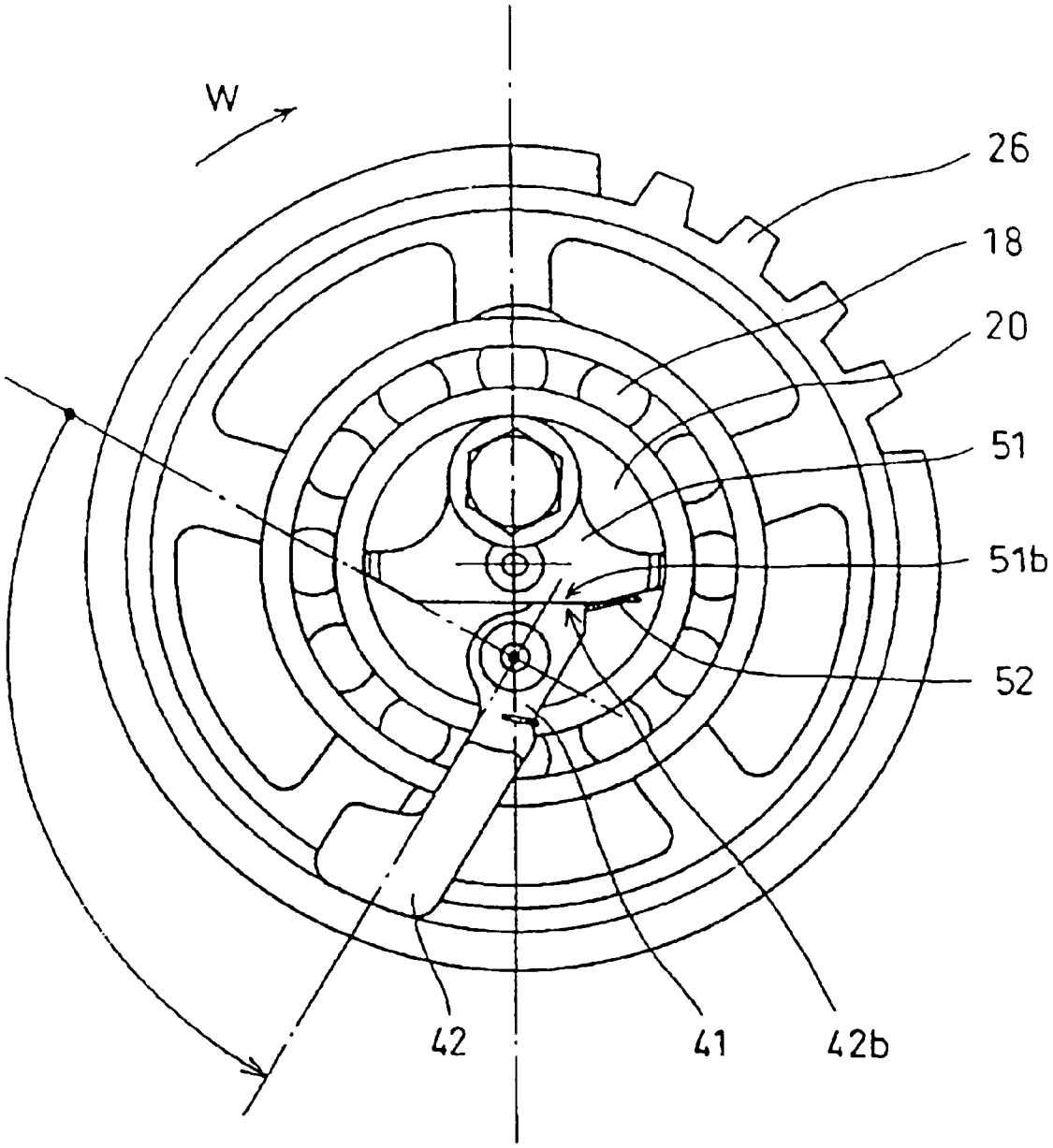
FIG. 17 is a view showing the camshaft and members linked to the camshaft from the right side of the camshaft, and shows the position of the decompression member of the camshaft during low-speed rotation.

FIG. 17 is a view of the camshaft 20 and the centrifugal weight 42 as viewed from the right of the camshaft 20 when the rotational speed of the engine increases so that the camshaft 20 rotates at a high speed greater than the decompression operation release rotational speed set as described above. When the centrifugal weight 42 rotates in a relative manner with respect to the camshaft 20 against the urging force of the coil spring 52 when the rotational speed of the camshaft 20 exceeds the set rotational speed due to application of centrifugal force, an end part 42*b* of the arm on the opposite side to the weight of the centrifugal weight 42 is then stopped at a position of making contact with stopper surface 51*b* at the time of high-speed rotation at a side surface different to the aforementioned one of the stopper 51. In this example, the centrifugal weight 42 is rotated through ninety degrees and then stopped.

Figure 18:
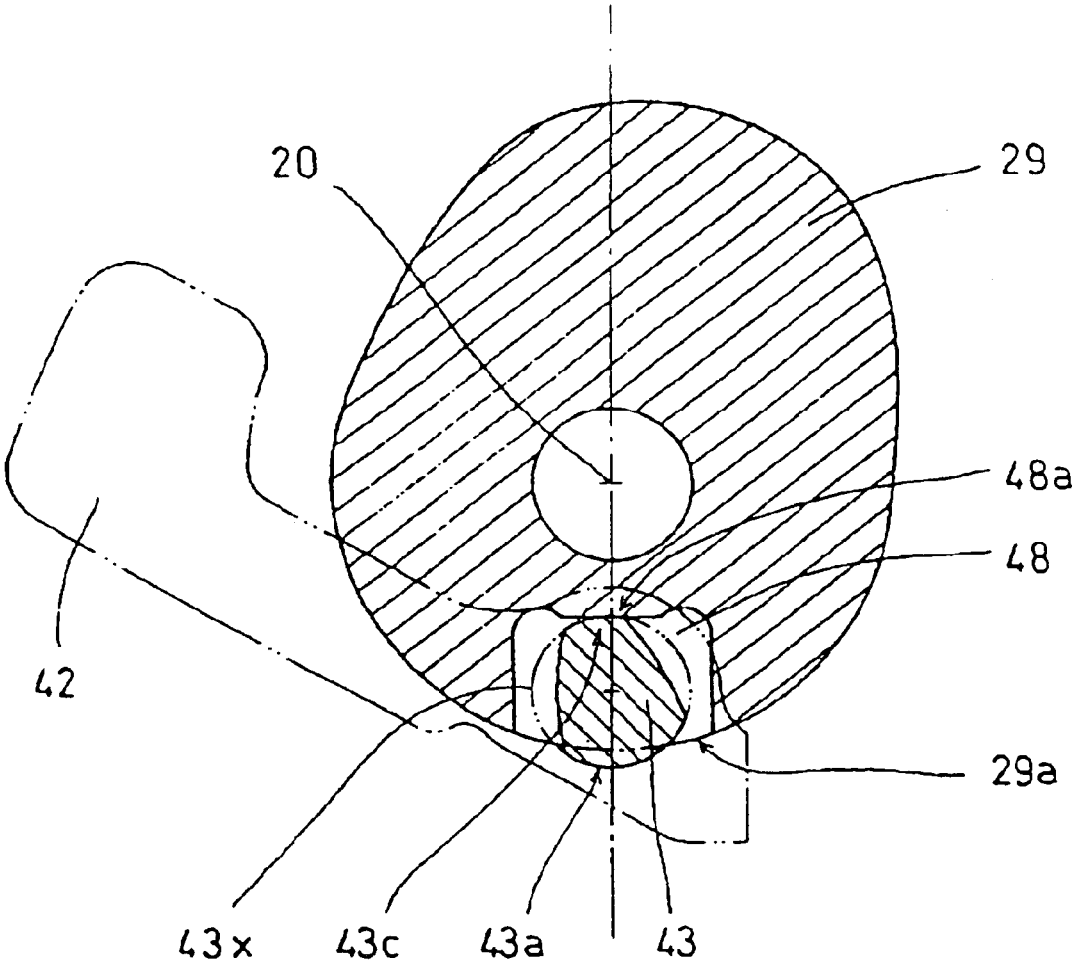
FIG. 18 is a view showing the positional relationship of the exhaust valves, decompression cam, and centrifugal weight, and shows the position during low-speed rotation of the camshaft.
Figure 19:
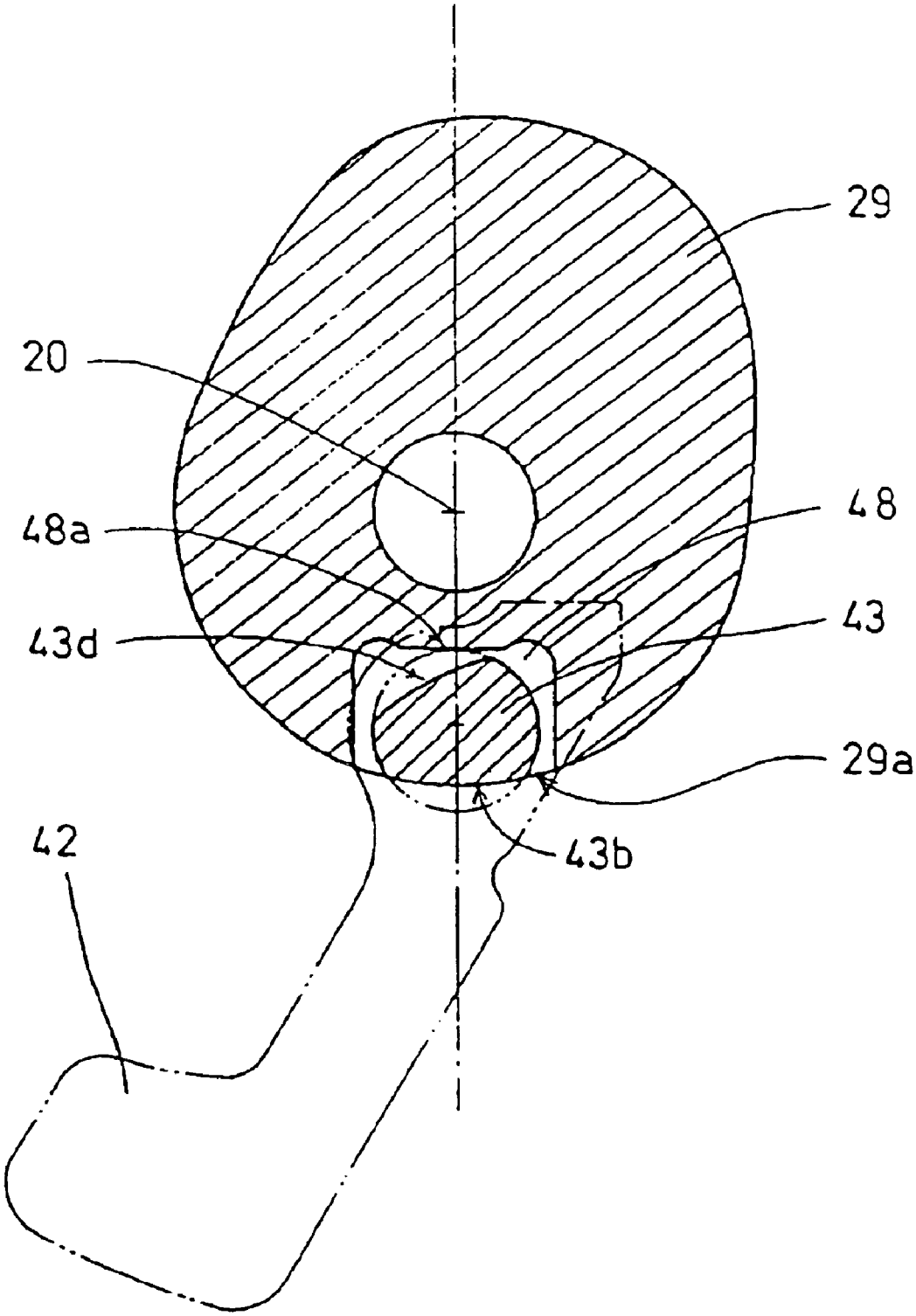
FIG. 19 is a view showing the positional relationship of the exhaust valves, decompression cam, and centrifugal weight, and shows the position during high-speed rotation of the camshaft.

Both FIG. 18 and FIG. 19 show the relative positional relationships of the exhaust cam 29, the centrifugal weight 42, and the decompression cam 43, with FIG. 18 showing the situation when the camshaft 20 is rotating at low-speed and FIG. 19 showing the situation when the camshaft 20 is rotating at high-speed. The centrifugal weight 42 and the decompression cam 43 are interlocking, and therefore their relative positional relationships do not change with rotation of the centrifugal weight 42. When the centrifugal weight 42 rotates, the relative positional relationship of the decompression cam 43 and the exhaust cam 29 changes.

When the camshaft 20 is rotating at low speed as shown in FIG. 18, the decompression acting surface 43*a* formed by one part of a cylinder-shaped outer surface 43*x* of the decompression cam projects further outwards then the exhaust cam outer surface 29*a*. This then pushes the roller 31 (FIG. 1) of the rocker arm 23 up, and the exhaust valves 10 are opened and closed for decompression at prescribed opening and closing timings and lift amounts.

The decompression cam 43 is subjected to pushing force from the roller 31 when the roller 31 makes contact with the decompression acting surface 43*a*. A decompression cam supporting surface 43*c* formed on the opposite side to the decompression acting surface 43*a* of the decompression cam 43 comes into contact with the flat bottom surface 48*a* of the decompression cam containing hole 48. The decompression cam supporting surface 43*c* is a surface formed from part of the decompression cam outer cylinder surface 43*x*. The combination of the decompression cam supporting surface 43*c* and the flat bottom surface 48*a* constitutes a type of bearing.

When the rotational speed of the engine is increased so that the camshaft 20 starts high-speed rotation, the decompression cam 43 operating in unison with the centrifugal weight 42 rotates relatively with respect to the camshaft 20, i.e. with respect to the exhaust cam 29, and the state shown in FIG. 19 is adopted. The decompression releasing surface 43*b* formed by cutting away part of the outer surface of the decompression cam 43 so as to coincide with the exhaust cam outer surface 29*a* then faces in the direction of the opening 48*b* of the decompression cam containing hole 48. The decompression releasing surface 43*b* does not project further outwards than the exhaust cam outer surface 29*a* and the decompression cam 43 therefore cannot be pressed by the roller 31 of the rocker arm 23. As a result, the decompression action is released.

The escape surface 43*d* formed by cutting away part of the outer surface of the decompression cam 43 is formed on the opposite side to the decompression releasing surface 43*b* of the decompression cam 43. The decompression releasing surface 43*b* does not project further outwards than the exhaust cam outer surface 29*a* when the camshaft 20 is rotating at high-speed, and pushing force is therefore not applied from the roller 31 at the decompression cam 43. When the camshaft 20 rotates at low speed, the type of bearing configured from a combination of the decompression cam supporting surface 43*c* and the flat bottom surface 48*a* is not required. When the decompression cam 43 rotates from a position of low-speed rotation to a position of high-speed rotation, it is necessary for the rotation to take place smoothly. Because of this, the escape surface 43*d* is formed and it is ensured that the decompression cam 43 does not make contact with the flat bottom surface 48*a* of the decompression cam containing hole 48 so as to reduce frictional resistance.

As described above, in this embodiment, the centrifugal weight 42 is arranged at the end of the camshaft 20, and the decompression cam 43 coupled to the centrifugal weight 42 via the rotatable shaft 44 is arranged to as to pass through the bearing 18 close to the end of the camshaft 20 and extend as far as the cam projection of the exhaust cam 29. A decompression arm such as in the related art extending from the position of the decompression cam to the tip of the rocker arm is therefore not necessary. As a result, in this embodiment, the structure is simplified, and the cylinder head can be made small.

In this embodiment, the bearing 44*a* (FIG. 3, FIG. 12) supporting the rotatable shaft 44 at the right end of the rotatable shaft 44 of the decompression member, and the type of bearing (FIG. 18) supporting the decompression cam 43 configured from the decompression cam supporting surface 43*c* and the bottom surface 48*a* of the decompression cam containing hole 48 are formed so as to be spaced away at the left and right of the cam projection of the intake cam. The bearing gap can therefore be kept substantial, and durability of the decompression device is improved.

The camshaft holder of this embodiment is in the form of a holder divided into two upper and lower parts above and below a center line position of the camshaft 20, of the lower camshaft holder 15 formed at the cylinder head 1 and the upper camshaft holder 16 fastened using the bolt 17. The camshaft 20 can therefore be supported by the pair of main bearings 18 and 19 having common internal and external diameters. The bearing members can therefore be made common, the types of parts can be reduced, and ease of assembly can be enhanced.

The decompression cam 43 of this embodiment is such that the roller 31 comes into direct contact with the decompression cam 43 in combination with the exhaust cam 29 touching the roller 31 of the rocker arm 23. Therefore, as a point of difference from the structure in the related art where contact is made with the decompression cam by a slipper, the sliding friction of the projection portions of the decompression cam can be reduced. The cam projection of the decompression cam can therefore be made smaller, and this contributes to making the bearing for supporting the decompression cam smaller.

While the invention has been described in particular embodiments, it is to be understood that the words which have been used are words of description rather than limitation and that changes within the purview of the appended claims may be made without departing from the true scope and spirit of the invention in its broader aspects.

We claim:

1. A decompression device for an internal combustion engine equipped with intake valves and exhaust valves and having a cylinder head provided with a pair of left and right camshaft bearings sandwiching the intake valves and exhaust valves, comprising a camshaft having cam projections for at least a pair of intake cams between camshaft side bearings corresponding to the pair of left and right bearings, and a decompression member with a decompression cam with a centrifugal weight arranged at a camshaft end passing through the bearing close to the camshaft end so that a tip thereof is arranged in the vicinity of the cam projections, with the decompression member comprising the centrifugal weight, the decompression cam, and a rotatable shaft coupling the centrifugal weight and the decompression cam in an integral manner.

2. The decompression device for an internal combustion engine as disclosed in claim 1, wherein a power transmission member for transmitting power from the crankshaft to the camshaft is provided at the outer side of one of the bearings of the pair of left and right camshaft bearings, the intake valve cam projection of the cam projections is provided close to the bearing on the opposite side to the side where the power transmission member is installed, and the pair of bearings supporting a rotating shaft of the decompression member is formed split to the left and right of the intake valve cam projection.

3. The decompression device for an internal combustion engine as disclosed in claim 2, further comprising a bearing member with common internal and external diameters provided between the cylinder head and the camshaft.

* * * * *